United States Patent [19]

Boser et al.

[11] 4,377,122

[45] Mar. 22, 1983

[54] ELASTIC METERING DEVICE FOR SEWING MACHINE

[75] Inventors: Ronald J. Boser, Dix Hills; Henry J. Watts, East Northport, both of N.Y.

[73] Assignee: Union Special Corporation, Chicago, Ill.

[21] Appl. No.: 308,020

[22] Filed: Oct. 2, 1981

[51] Int. Cl.[3] ..... D05B 3/12; D05B 21/00; D05B 27/16

[52] U.S. Cl. ..... 112/265.1; 112/121.26; 112/305; 112/152; 112/318

[58] Field of Search ..... 112/121.26, 121.27, 112/262.1, 262.3, 265.1, 2, 305, 307, 152, 318, 322, 130

[56] References Cited

U.S. PATENT DOCUMENTS

| | | | |
|---|---|---|---|
| 13,661 | 10/1855 | Singer . | |
| 434,009 | 8/1890 | Welch . | |
| 2,153,244 | 4/1939 | Galkin | 112/121.26 |
| 2,231,648 | 2/1941 | Weis | 112/121.26 |
| 2,266,538 | 12/1941 | Evans | 112/121.26 |
| 2,542,764 | 2/1951 | Gibbons, Jr. | 112/2 |
| 3,000,332 | 9/1961 | Sigoda | 112/121.26 |
| 3,174,701 | 3/1965 | Frankel . | |
| 3,244,129 | 4/1966 | Steingruebner | 112/2 |
| 3,499,619 | 3/1970 | Newell . | |
| 3,648,632 | 3/1972 | Miller | 112/130 |
| 3,779,441 | 12/1973 | Policella . | |
| 4,102,282 | 7/1978 | Hsiao et al. | 112/121.26 |

*Primary Examiner*—H. Hampton Hunter
*Attorney, Agent, or Firm*—John W. Harbst; John A. Schaerli

[57] ABSTRACT

An elastic metering device including a plurality of individual tape feeding and tensioning mechanisms having a common drive shaft, with each mechanism being adapted to independently act on one of a plurality of tapes as they advance toward the machine. Each tape feeding and tensioning mechanism includes an operator controlled variable speed drive mechanism for selectively affecting the manner in which each mechanism acts on each tape.

30 Claims, 10 Drawing Figures

10
14
16
18
20
22
22
26
28
29
32
34
36
40
42
42
44
44'
46
48
50
52
54
58
74
75
76
82
86
12
3
3

57
52
62
54
58
86
68
78
80
82
70
48
75
76
W
T
8
64
66
46
72
74
40
42
20
22
24
10
12

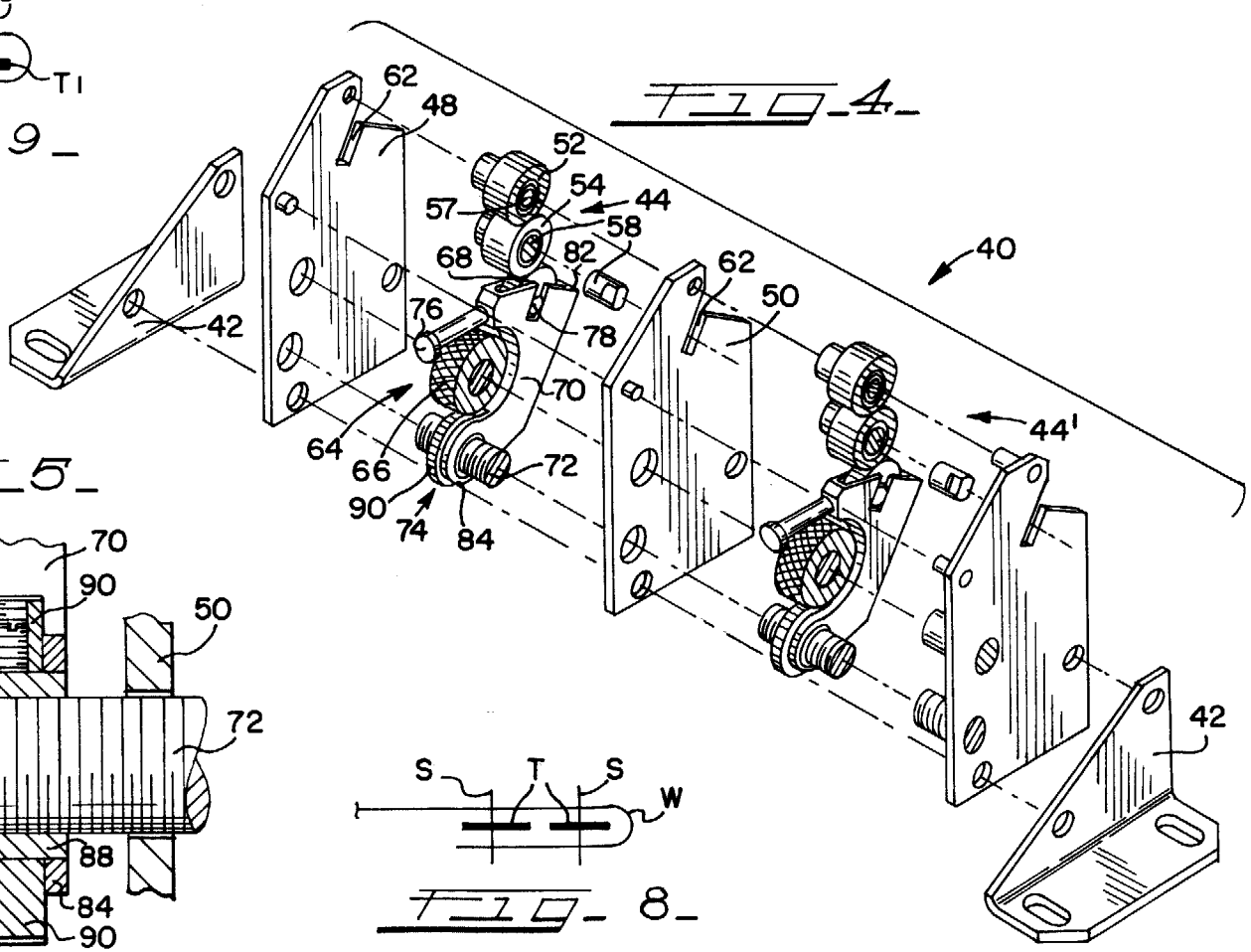
FIG. 4
FIG. 8
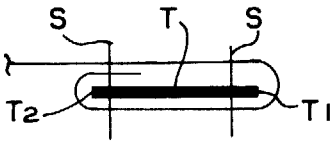
FIG. 9
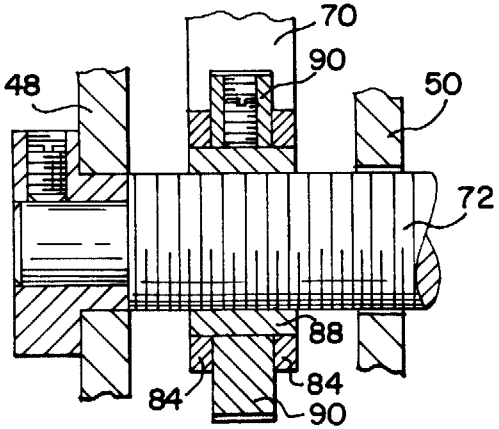
FIG. 5

ELASTIC METERING DEVICE FOR SEWING MACHINE

FIELD OF THE INVENTION

The present invention relates to sewing machines and more particularly to an elastic metering device for sewing machines.

BACKGROUND OF THE INVENTION

Sewing machine elastic metering devices, per se, are known in the art. Most of these mechanisms include a pair of cooperatively arranged rollers for feeding elastic strips to sewing machines. Some of these mechanisms use various clutch assemblies for imparting motion to the rollers. The use of clutch assemblies, however, also require machine speeds to be reduced whereby reducing production.

In some sewing operations it is desirous to simultaneously feed more than one elastic tape to a sewing machine at varied rates of speed. An example of such an operation may be garment waistbands incorporating two or more variably tensioned elastic tapes for a contoured application incorporating two or more elastic tapes. Most of the heretofore known elastic metering mechanisms are not designed to feed more than one elastic tape to a machine. Accordingly, the present invention is introduced for the first time to accomplish feeding more than one elastic tape to a sewing machine at varying rates from a common input shaft. In addition, the present invention does not include any of those mechanisms which require drastic reductions in machine speeds to accomplish the desired result.

SUMMARY OF THE INVENTION

In view of the above, and in accordance with the present invention there is provided a metering device which includes a plurality of aligned but severally operable tape feeding and tensioning mechanisms operating from a common drive shaft. Each of the mechanisms is adapted to independently act on one of a series of adjacently arranged elastic tapes at a location proximate the sewing instrumentalities of the machine. By this construction, two or more tapes may be independently acted upon before being secured to a workpiece.

Each independent tape feeding and tensioning mechanism includes a pair of cooperatively arranged feed rollers which are operatively coupled to a common drive shaft through a unique variable speed drive mechanism. One of the rollers in the pair is slideably mounted to allow the tape to be introduced between the rollers. The variable speed drive means of the present invention is operator controlled to selectively impart premeasurable advance rates to each pair of said rollers. The unique drive means of this invention includes a roller, which is preferably frusto-conical in shape, and a yieldably mounted idler wheel that is tangentially associated with the conical roller and operative to transmit motion between the common input shaft and the feed rollers. The idler wheel is slideably mounted on one end of a carrier frame the other end of which is constrained to move in a path extending parallel to the input shaft. Means are also provided for shifting the idler roller and carrier frame longitudinally with respect to the frusto-conical roller such that the feed rate developed by the feed rollers may be selectively modulated according to the requirements to be performed.

It is therefor the primary object of this invention to provide an apparatus capable of simultaneously handling a plurality of elastic tapes with varying degrees of tension.

Another object of this invention to provide an apparatus for delivering a multitude of tapes to a sewing machine, wherein each of a number of tapes may be independently operated in a plurality of modes of operation from a common drive means.

It is yet another object of this invention to provide a unique method of handling a plurality tapes at a location in advance of the sewing machine.

In the accompanying drawings annexed hereto and forming part of this specification, the present invention is shown embodied as an elastic metering device associated with a sewing machine, but it will be understood that some of the features of this invention can be embodied in other devices and the drawings are not to be construed as defining or limiting the scope of the invention, the claims appended to this specification being relied upon for that purpose.

In the drawings

FIG. 3 is an enlarged sectional view of the present invention taken along line 3—3 of FIG. 1;

FIG. 4 is an exploded perspective view of the present invention;

FIG. 8 is a schematic sectional view of a waistband taken along line 8—8 of FIG. 6;

FIG. 9 is a schematic sectional view of a waistband similar to FIG. 8 but including a wide elastic strip.

DESCRIPTION OF THE PREFERRED EMBODIMENT

Figure 1:
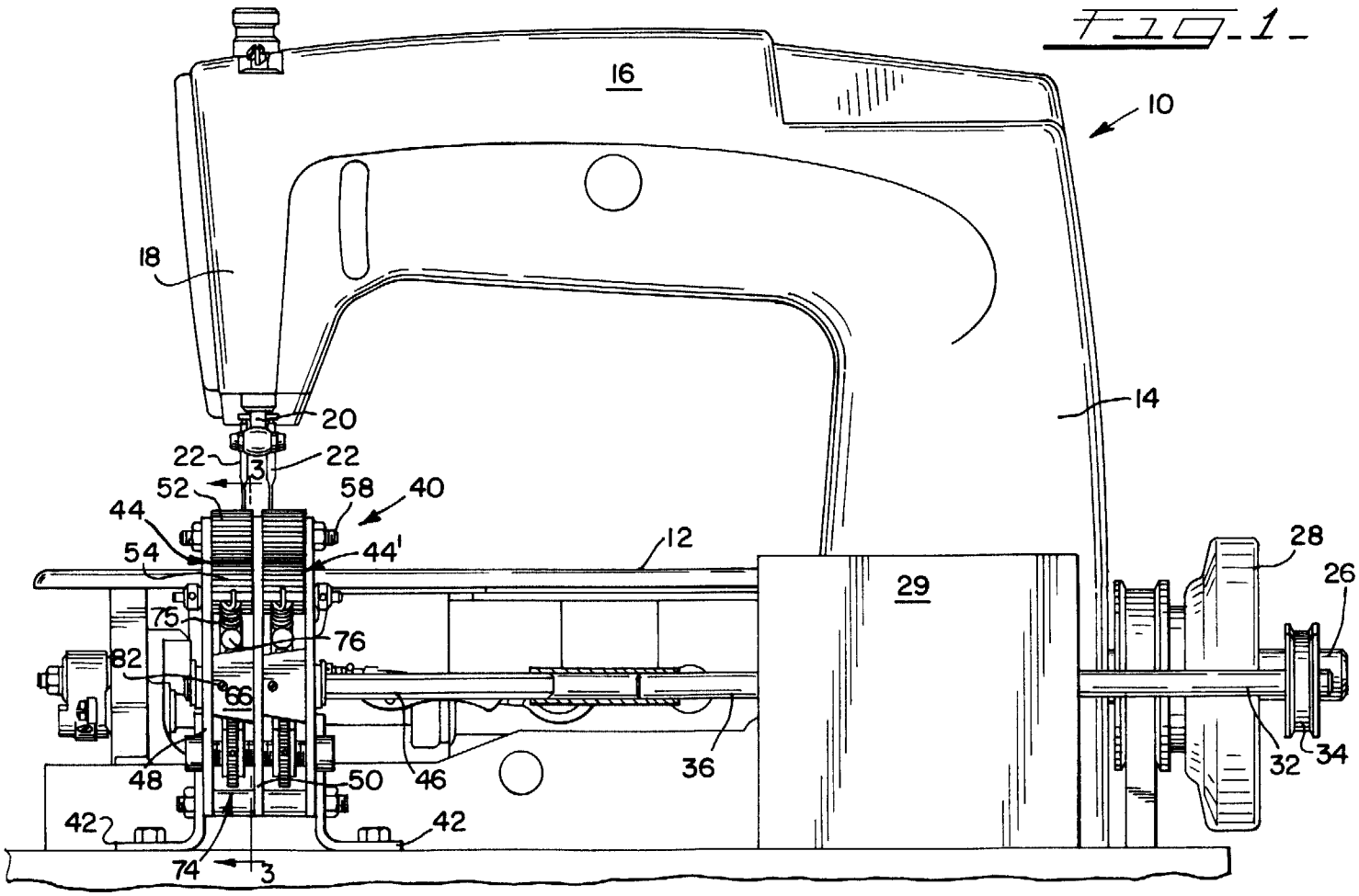
FIG. 1 is a front elevational view of a sewing machine with the present invention applied thereto.

Referring now to the drawings, wherein like reference numerals indicate like parts throughout the several views, one preferred form of the invention is illustrated as associated with a flat bed sewing machine 10. For purposes of this illustration, the machine shown is a Class 57700 machine manufactured by Union Special Corporation but it will be appreciated that the invention is equally aplicable to other types or Classes of sewing machines as well. Suffice it to say, the machine 10 includes a work supporting base 12, a vertical standard 14 and an overhanging arm 16 terminating in a needle head 18. Within the head there is mounted for vertical reciprocation a needle bar 20 adapted to carry one or more laterally spaced needles 22 defining a sewing station work area. During the machine operation, and in a well known manner, the needles combine with other stitch forming devices to concatenate threads carried thereby into stitches for securing together suitably arranged workpieces. The sewing operation to which the instant invention applies, concerns securing two or more side-by-side elastic strips to a workpiece or garment waistband. As shown in FIG. 8, two or more strips of elastic tape T, horizontally arranged in a spaced, parallel relation relative to one another, may be included in a waistband W. Typically, the waistband is formed by surrounding tensioned elastic strips with material and subsequently attaching the strips to the material with a series of stitches S. Of course, the number of needles provided in the machine will be determined by the character of the seam desired to be produced by the machine. For purposes of conjointly advancing the work and the tape in the region of the stitch forming devices, there is provided a suitable work feeding mechanism 24.

Extending longitudinally of the base is a main drive shaft 26. The shaft 26 projects outwardly from the frame at its right end (FIG. 1) and has secured thereto a combined hand wheel and pulley 28 through which power may be supplied to the machine. Driven from the machine, or other suitable power source, is a "Zero-Max" speed reduction unit manufactured by Zero-Max Company, Minneapolis, Minn., generally referred to by reference number 29. Input to unit 29 is supplied by shaft 32 which is connected through a belt 34 to the machine main shaft for driving of output shaft 36. The speed reduction unit allows the operator to preselect and, if desired, vary the ratio of the input rotational speed of shaft 32 relative the rotational output speed of shaft 36. All of the foregoing described construction is commonly known in the art, and thus will not be further described in detail, our invention being described below in detail in conjunction therewith.

Turning now to the present invention which provides a metering device assembly means 40 for insuring the deliver of two or more accurately measured and tensioned lengths of elastic tape to the sewing machine work station. The metering device assembly 40 is located adjacent or proximate to the stitch forming instrumentalities of the machine and is operated as a function of machine speed. The instant invention includes a support means 42 which, in the illustrated embodiment, is secured to the machine's supporting table T. It will be appreciated, however, that the metering device could be secured in suitable positions. Carried by the support means 42 in a side-by-side or spacial relationship generally corresponding to the space relationship between the tapes are a series of aligned, substantially identical tape feeding and tensioning mechanisms 44 and 44'. Each tape feeding and tensioning means is adapted to independently act on one of said elastic tapes that are included in the waistband. Accordingly, the number of contiguously arranged tape feed and tensioning mechanisms provided will be determined by the character of the seam desired to be produced. Journalled through each of the mechanisms is a shaft 46 which supplies an operative drive means common to all of the feed and tensioning mechanisms. In the illustrated embodiment, shaft 46 extends parallel to the machine main shaft 26 and is connected to the output shaft 36 of the "Zero-Max" speed reduction unit. It should be appreciated, however, that any suitable power source, other than the "Zero-Max" unit, would suffice.

Since the tape feeding and tensioning assemblies and associated structure may be substantially the same, the mechanism 44 will be described as representative in connection with FIGS. 1, 3, and 4. The means forming the tape feeding and tensioning mechanism includes supports or brackets 48 and 50 which form an extension of the support means 42. Captively arranged between and carried by the brackets 48 and 50 are a pair of cooperatively arranged knurled surface rollers 52 and 54 between whose axes the tape is adapted to pass. While both rollers are prevented from endwise movement in the mechanism, and are generally coaxially mounted with respect to the feed rollers of the other mechanisms, roller 54 is adapted to slide in a generally vertical direction. On the other hand, roller 52 freely rotates about a fixed axis provided by shaft 57 which extends parallel to the common input shaft 46. The feed roller 54 is of cylindrical form and is journalled about a stub shaft 58. Shaft 58 has a flattened portion 60 arranged at each of its ends. This flattened portion is to be received in a generally vertical track 62 provided in each of the extension brackets. In this manner, roller 54 is allowed to "float". By this construction, the tape can be introduced between the rollers. It will be understood that the end portion of shaft 58 extends into the support bracket only half the distance of the bracket. By this design, the bracket disposed between mechanisms may serve a dual purpose; that is, to support the stub shaft on either side of its placement.

As shown in FIGS. 3 and 4, operatively disposed between the common input shaft 46 and each pair of cooperatively arranged feed rollers, is a variable speed drive means 64. The variable speed drive means is operator controlled and is adapted to operatively couple the common input shaft with each of the tape feeding and tensioning mechanisms. More particularly, the variable speed drive means serves to selectively impart premeasurable advance rates to each pair of rollers to achieve the desired degree of tension on each individual tape. It will be understood that since each operable tape feed and tensioning mechanism includes an independent variable speed drive means, each mechanism can be operated or regulated at any desired ratio or speed relative any other mechanism and relative the machine.

Figures 2, 5, 6, 7, 10:
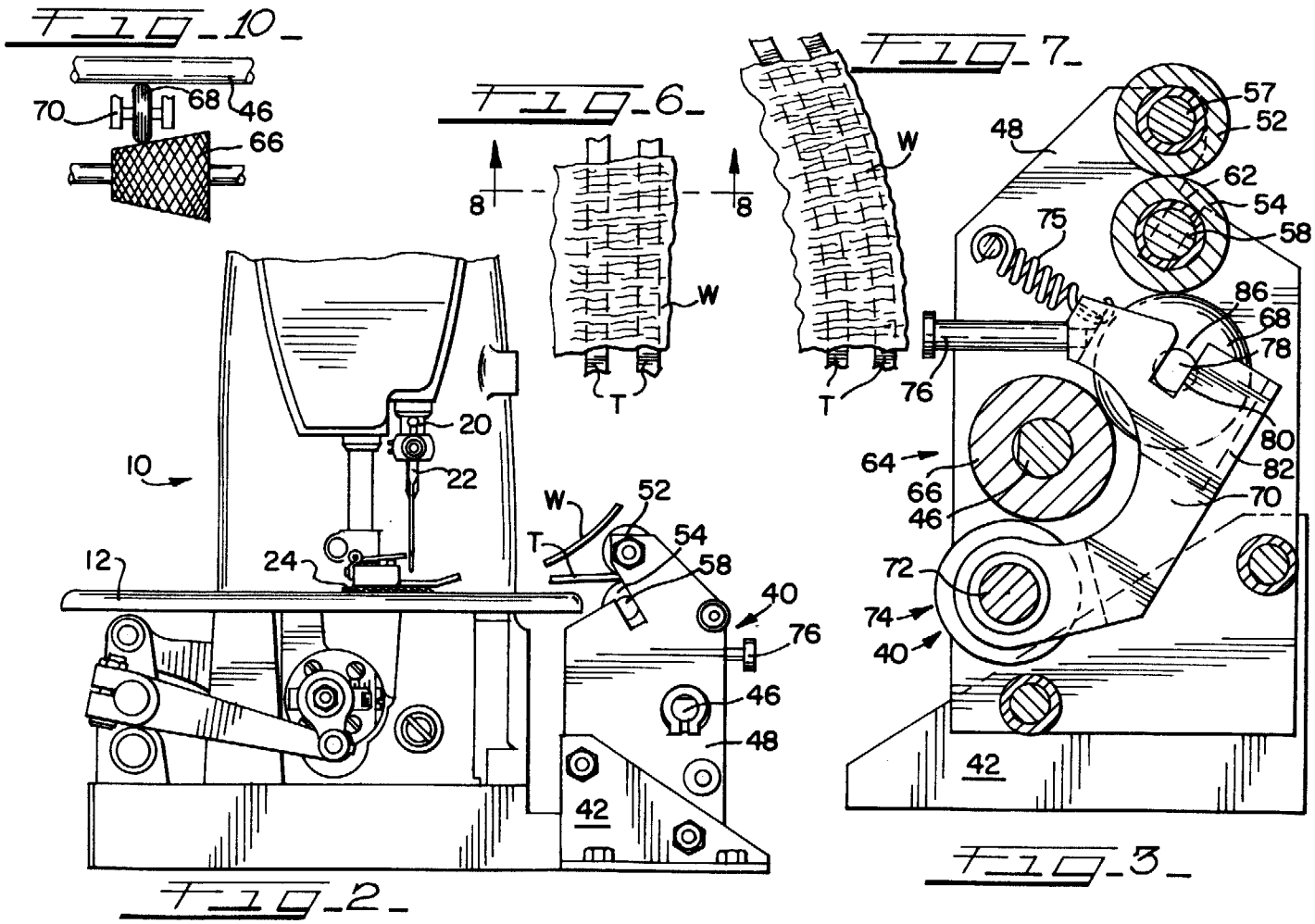
FIG. 2 is a partial side elevational view of FIG. 1.
FIG. 5 is an enlarged sectional view of a presently preferred operator control means associated with the present invention.
FIG. 6 is a fragamentary plan view of two elastic tapes incorporated in a waistband.
FIG. 7 is a fragamentary plan view of an article similar to that illustrated in FIG. 6 but showing a contoured waistband.
FIG. 10 is a schematic representation of the operable drive means associated with the present invention.

The importance of independently being able to adjust the speed of the respective feed rollers is apparent when viewing FIGS. 6 and 7. In FIG. 6 there is shown two elastic tapes T incorporated within a waistband W. Normally, the two tapes would need to be fed at the same feed rate. In some cases, however, it may be desirous to feed the tapes at various feed rates. With the present invention, wherein there are provided independent variable speed drive means for each pair of rollers that are adapted to act independently on each of the tapes it is possible to accomplish the desired goal. As seen in FIG. 7, wherein it may be desirous to feed elastic tapes to a garment, workpiece, or waistband which is curved in configuration, one of the two tapes T being supplied needs to be provided with a different length than the other tape. Because the present invention has independent means for acting on each tape, it is again possible to achieve the desired goal in this application. Whereas, in mechanisms that have been known, to the industry, it would be difficult to feed one tape at a feed rate which is different than a tape which is closely adjacent thereto.

As schematically illustrated in FIG. 10, the operable drive means of the present invention includes a knurled roller 66, which is preferable frusto-conical in shape, and a yieldably mounted idler wheel or roller 68 which is tangentially associated with the conical roller and which is operative to transmit motion between the input shaft 46 and the rollers 52 and 54. As shown in FIGS. 3 and 4, idler wheel or roller 68 is carried on one end of a carrier frame 70. The other end of the carrier frame 70 is rockably mounted about a stationary auxiliary shaft 72 which is arranged parallel to the input drive shaft 46. Operator controlled means 74 are also provided for laterally shifting the idler wheel 68 relative to the conically shape periphery of member 66 such that the speed of the rollers may be selectively modulated.

The carrier frame 70 is biased under the influence of spring 75 and is adapted to influence the vertical position of the floating roller 54. Because the carrier frame is yieldably biased, the operator may, at will, interrupt the feeding action of any of the feeding and tensioning mechanisms ny merely displacing its associated idler wheel from its operative position, shown in FIG. 3, a non operative position. In the preferred embodiment, the operator may remove the carrier frame and idler wheel to a non operative position by pressing on a member 76 which, as seen in FIG. 3, extends beyond the periphery of the bracket means and is readily available to the operator. Sufficient force against the member 76 will overcome the action of spring 75 resulting in displacement of the idler wheel whereby the transmission of rotary movement between the common input shaft and the rollers 52 and 54 will be interrupted. In the embodiment shown, the idler roller 68 influences the operative position of roller 54 and when displaced allows the roller 54 to move downward in its track whereby creating a gap between the rollers.

In the preferred embodiment, the frusto-conical roller 66 of each mechanism is secured to the common input shaft 46 by any suitable means such as screws 82 (FIG. 1). The idler wheel 68 is biased under the influence of spring 75 into tangential contact with the conical roller 66 and the floating feed roller in each pair of cooperatively arranged rollers. The idler wheel 68 is journaled on a stub shaft 78 which is provided with a flattened portion 80 at each of its ends. At both of its ends, the carrier frame is provided with bifucated arms 82 and 84. The bifucated arms 82 are adapted to receive the wheel 68 and the stub shaft 78. The bifucated arms 82 are also formed with the track 86 into which the flattened portion 80 of stub shaft 78 is received. In this manner, the idler is allowed to "float". The idler wheel needs to be floated because of the varying positions it must assume as a result of its tangential contact with varying diameters on the conical shape periphery o member 66 and variety of tape thicknesses.

The operator control means 74 for regulating the advance rate of each mechanism is received in the bifucated arms 84 arranged at the opposite end of the carrier frame 70. As may be best seen in FIG. 5, the operator controlled means of the present invention includes the auxiliary shaft 72, a member 88 telescopically received on the auxiliary shaft and an element 90 which is readily accessible to the operator and which in cooperation with member 88 is effective to selectively manipulate the position of the frame 70 and idler wheel 68 longitudinally of the conically shaped roller. In the illustrated embodiment, the stationary auxiliary shaft 72 is externally threaded and the member 88 is threaded thereover. Accordingly, when member 88 is rotated in a manner described below, it simultaneously moves in a linear direction along the length of the auxiliary shaft in a direction dependent on the direction of rotation. Arranged in a fixed relationship with the member 88 is the annularly formed element or wheel 90. Element 90 is captively received between the bifucated arms of carrier 70 but is free to rotate in relation thereto. Accordingly, when element 90 is rotated by the operator, member 88 is simultaneously rotated therewith thereby resulting is linear displacement. Because element 90 is captively arranged in the arms 84 of the frame 70, the linear motion of member 88 translates into linear motion of the carrier frame 70 and the idler wheel carried thereby changing the tangential relationship of the idler wheel with respect to the conical roller. Changing the tangential relationship of the idler wheel with respect to conical roller results in varying degrees of rotation being induced to the feed rollers 52 and 54 whereby individually altering the mechanisms feed rate.

In operation, the tapes which are to be sewn to the workpiece are individually arranged in each tape feeding and tensioning mechanism such that each mechanism may independently act on each tape. Power is supplied to the common input shaft 46 as a function of the sewing machine speed. Depending on the application being performed, the variable speed drive mechanism of each tape feed and tensioning operative assembly has been individually adjusted relative the feed rate of the feed mechanism 24. Thus, as the individual tapes move towards the machine they are independently acted upon by each mechanism and only the required length of tape under its appropriate tension is delivered to the sewing machine instrumentalities. It is foreseeable that in some operations it may be desirous to advance a wide strip of tape T (FIG. 9), incompassing, at least, the width of two feeding and tensioning units to a sewing machine wherein the lateral edges of the tape T 1 and T 2 must be advanced at different feed rates. Of course, with the present invention, to accomplish such an end would be possible. In such an application and with the present invention one feeding and tensioning unit could act on one lateral edge of the strip at a predetermined rate, while the second feeding and tensioning unit would work or act on the opposite lateral edge of the tape whereby accomplishing the desired result.

Thus it is apparent that there has been provided, in accordance with the invention, an Elastic Metering Device For Sewing Machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modification, and variations as fall within the spirit and broad scope of the appended claims.

Having adequately described our invention, what we claim is:

1. In combination with a sewing machine having reciprocal needle means adapted to secure a pair of elastic tapes to a waistband, a tape delivery apparatus comprising:

a pair of substantially identical mechanisms which are operated by a common input shaft, each mechanism being adapted to advance one of said elastic tapes; and individual operator controlled means operatively associated with each of said mechanisms for selectively controlling the advance of tape to said sewing machine whereby two tapes having varying degrees of tension may be delivered to the machine simultaneously.

2. Apparatus for feeding a series of elastic tapes to a sewing machine in a spaced parallel relation relative to one another, said apparatus comprising:

an operative assembly for individually feeding and tensioning the tapes at a location proximate said machine, said operative assembly including a series of spatially arranged feeding and tensioning mechanisms all of which are driven from a common input shaft;

wherein each individual mechanism includes a pair of cooperating feed rollers adapted to have one elastic tape pass therebetween, and operator controlled means for effecting the tape advance rate of one pair of feed rollers relative to another pair of feed rollers.

3. The invention according to claim 2 where in said operator controlled means includes a frusto-conical shaped roller carried by said common input shaft, an idler wheel arranged in tangential contact with said frusto conical shaped roller and one of said pair of cooperating feed rollers and means for laterally shifting said idler wheel relative to said frusto conical shaped roller whereby varying the speed imparted to said rollers.

4. The invention according to claim 3 wherein said means for laterally shifting said idler wheel includes a carrier frame adapted to carry said idler wheel at one end thereof with the other end of said carrier frame being constrained to move along a line extending parallel to the input shaft and means associated with said other end of the carrier frame for selectively manipulating the lateral position of the frame and thereby the idler wheel.

5. Apparatus for feeding a plurality of adjacently arranged elastic tapes to the work area of a machine, said apparatus comprising:

a plurality of aligned tape feeding and tensioning means arranged adjacent the work area of the machine and operated by a common drive shaft each tape feeding and tensioning means includes a pair of cooperative roller means adapted to act on one of said tapes, an idler wheel operative to transmit rotational motion from said drive shaft to said roller means, and operator controlled means capable of individually varying the feed rate of each tape feeding and tensioning means.

6. An apparatus for advancing a series of adjacently arranged elastic strips to a sewing machine comprising:

support means;

a revolubly mounted input shaft adapted to be connected to a power source;

at least two pair of cooperatively arranged rollers carried by said support means, with each pair of rollers being adapted to act on one of said elastic strips;

at least two motion transmitting means for independently coupling each pair of rollers with said input shaft; and individual operator influenced control means for varying the input imparted to said rollers.

7. An apparatus according to claim 6 wherein each pair of cooperatively arranged rollers includes one movable roller having an axle mounted at its opposite ends in tracks formed in said support means.

8. An apparatus according to claim 7 wherein the other roller is carried for free rotation about a fixed axis.

9. An apparatus according to claim 7 wherein the mounting for said one roller substantially prevents endwise movement of the roller but permits generally vertical movement of said roller.

10. The invention according to claim 6 wherein each individual operator influenced control means includes a frusto-conical roller carried by said input shaft, a yieldably mounted idler wheel arranged in tangential contact with said frusto-conical roller and its respective pair of cooperatively arranged rollers, and means for laterally shifting said idler wheel relative to said frusto conical roller such that the speed of said cooperatively arranged rollers may be selectively modulated.

11. The invention according to claim 10 wherein said means for laterally shifting said idler wheel includes a carrier frame adapted to carry said idler wheel at one end thereof with the other end of said carrier frame being constrained to move along a line extending parallel to the input shaft, and means associated with said other end of the carrier frame for selectively manipulating the lateral position of the frame and thereby the idler wheel.

12. The invention according to claim 10 wherein said yieldably mounted idler wheel is effective to forcibly urge said movable roller into contact with the other of said rollers.

13. The invention according to claim 4 or 11 wherein said other end of said carrier frame is bifurcated and rockably mounted about an auxiliary shaft arranged parallel to the input drive shaft and said selective manipulation means comprises a telescopic member arranged over said auxiliary shaft and an element secured to said member and received in the bifurcated end of said carrier frame, said member and element being effective to laterally move the carrier frame and thereby said idler wheel a controlled amount upon rotation of said element.

14. In combination with a machine adapted to secure a series of contiguously arranged material strips to a workpiece, a strip feeding apparatus comprising:

a series of strip feeding and tensioning means contiguously arranged proximate said machine, each strip feeding and tensioning means being adapted to act on one of said strips; and a series of independent variable speed drive means for selectively imparting premeasurable advance rates to each of said strip feeding and tensioning means according to the desired degree of tension required and machine requirements.

15. Apparatus for feeding a series of horizontally arranged elastic tapes to a sewing machine having a series of laterally spaced needles defining a sewing area, said apparatus comprising:

support means arranged proximate said needles;

a plurality of aligned tape feeding and tensioning means carried by said support means and operably driven by a common drive shaft;

wherein each tape feeding and tensioning means includes a pair of cooperatively arranged rollers adapted to act on one of said tapes, an idler wheel effective to transmit motion between said drive shaft and said rollers, and operator controlled means for individually adjusting the feed rate of each tape feeding and tensioning means.

16. An apparatus according to claim 13 wherein said idler wheel is carried on a resiliently biased pivotal idler arm adapted to urge said idler wheel against one of said rollers.

17. In combination with a sewing machine having a stitching zone defined by a plurality of laterally spaced sewing needles capable of securing a series fo contiguously arranged tapes to a workpiece, a drive mechanism for said sewing machine and tape dispensing apparatus comprising:

an assemblage of tape feeding and tensioning mechanisms arranged proximate the stitching zone, said assemblage being operatively connected to said drive mechanism; and each tape feeding and tensioning mechanism being adapted to manage one of said contiguously arranged tapes and includes means for operating each mechanism at any desired ratio relative to any other mechanism.

18. A tape delivery apparatus adapted to feed a series of adjacently aligned elastic tapes to a sewing machine comprising:

a series of correspondingly aligned elastic tape handling mechanisms having a common input shaft and arranged proximate said machine for individually advancing each elastic tape toward said machine;

each of said mechanisms including an operator controlled means capable of individually regulating the mechanisms advance rates.

19. A tape delivery apparatus according to claims 1 or 18 wherein each of said mechanisms includes a pair of cooperatively arranged rollers between whose rotational axes said tape passes.

20. The invention according to claim 1 or 2 or 18 wherein said operator controlled means is effectively disposed between said common input shaft and said mechanism and includes a frusto conical roller and means selectively shiftable longitudinally of said roller.

21. The invention according to claim 1 or 2 or 12 wherein said operator control means includes a frusto conical shaped roller, an idler roller arranged in tangential contact with said roller and disposed between said common input and its associated feeding and tensioning mechanism, and means for shifting said idler roller longitudinally of said conically shaped roller whereby effecting the delivery rate of its associated feeding and tensioning mechanism.

22. In a sewing machine having a sewing area defined by at least two spaced reciprocable needle means adapted to secure at least two relatively spaced elastic tapes to a workpiece means and an elastic metering device comprising:

a first operative means adapted to advance and tension one of said tapes at a location proximate the sewing area;

a second operative means adapted to advance and tension the other tape at a location proximate the sewing area; and said first and second operative means having a common drive shaft and included individual mechanisms for regulating the feed rate of each operative mechanism relative to one another and the machine.

23. An elastic tape handling apparatus for a sewing machine, comprising:

support means;

two or more pairs of cooperatively arranged rollers carried by said support means and capable of feeding an elastic tape;

a common drive shaft capable of imparting rotation to said pair of rollers; and operator influenced means disposed between said common drive shaft and each pair of cooperatively arranged rollers for effecting the rotational feed rate imparted to said feed rollers.

24. An elastic tape handling apparatus according to claim 23 wherein said operator influenced means includes a member carried by said common drive shaft having a conically shaped periphery, a yieldably mounted roller arranged in tangential contact with said member and one of said pair of cooperatively arranged rollers, and means capable of laterally shifting said yieldably mounted roller longitudinally with respect to said member whereby varying the rotational speed imparted to said pair of rollers.

25. An apparatus for advancing at least two side-by-side arranged elastic tapes to a sewing machine comprising:

a support frame;

a first tape feeding and tensioning mechanism adapted to act on one of said elastic tapes and which includes a first pair of cooperatively arranged feed rollers;

a second tape feeding and tensioning mechanism adapted to act on the other elastic tape and which includes a second pair of cooperatively arranged feed rollers;

said first and second tape feeding and tensioning mechanisms having a common input drive shaft;

individual rotation inducing means for each of said tape feeding and tensioning mechanisms capable of detachably interconnecting the drive shaft and each pair of cooperatively arranged rollers; and means associated with each of said rotation inducing means for selectively effecting the rotation imparted to said rollers.

26. An apparatus according to claim 25 wherein each pair of cooperatively arranged rollers includes a roller having a fixed rotational axis and floating roller.

27. A device for supplying a plurality of adjacently arranged tapes to a sewing machine having a plurality of spaced needles adapted for reciprocatory movement, said device comprising:

a plurality of aligned tape feed and tensioning assemblies with each assembly carrying a pair of cooperatively arranged feed rollers adapted to act on one of said tapes;

a common input drive for all of said tape feed and tensioning assemblies; and mechanisms operatively interposed between said input drive and said feed rollers for individually selecting the feed advance rate of each tape relative to the machine and to the other tapes.

28. A method for advancing an elastic strip to a sewing machine comprising the steps of:

feeding and tensioning one lateral edge of said elastic strip at a first advance rate; and feeding and tensioning the opposite lateral edge of said elastic strip at an advance rate different from the first advance rate.

29. A method for advancing at least two elastic strips to a sewing machine comprising the steps of:

feeding and tensioning one of said elastic strips in the proximate area of the sewing machines at a first advance rate; and simultaneously feeding and tensioning the other of said elastic strips in the proximate area of the sewing machine at an advance rate different from the first advance rate.

30. A method for forming a garment waistband incorporating at least two strips of elastic material comprising the steps of:

feeding and tensioning one of said elastic strips at a first advance rate;

simultaneously feeding and tensioning the other of said elastic strips at an advance rate different from the first advance rate;

surrounding the tensioned elastic tapes with material arranged in a waistband type configuration and conjointly advancing the waistband with the elastic strips to a sewing machine; and securing the waistband material and the elastic strips together.

* * * * *